US008322545B1

(12) United States Patent
Golias, Jr. et al.

(10) Patent No.: US 8,322,545 B1
(45) **Date of Patent: *Dec. 4, 2012**

(54) CURVED BIN FOR SHELF

(75) Inventors: Bernard J. Golias, Jr., Twinsburg, OH (US); Gary W. James, Parma Heights, OH (US); Robert J. Golias, Solon, OH (US)

(73) Assignee: Metal Fabricating Corporation, Cleveland, OH (US)

( * ) Notice: Subject to any disclaimer, the term of this patent is extended or adjusted under 35 U.S.C. 154(b) by 280 days.

This patent is subject to a terminal disclaimer.

(21) Appl. No.: 11/784,013

(22) Filed: Apr. 5, 2007

Related U.S. Application Data

(60) Provisional application No. 60/876,233, filed on Dec. 21, 2006.

(51) Int. Cl.
*A47F 5/00* (2006.01)

(52) U.S. Cl. ..... 211/135; 211/119.003; 312/351

(58) Field of Classification Search ..... 211/94.01, 211/90.01, 135, 187, 134, 103, 190, 193, 211/183, 184, 126.1, 133.6, 119.003; 248/247, 248/248, 235, 231.81; 108/46, 47, 108, 193, 108/147.16; 312/351, 408
See application file for complete search history.

(56) References Cited

U.S. PATENT DOCUMENTS 791,546 A * 6/1905 Ellett ..... 211/183
1,523,653 A 1/1925 Larson et al.
1,840,485 A * 1/1932 Butler ..... 206/0.81
2,101,686 A * 12/1937 Offutt ..... 206/511
D116,600 S 9/1939 Thorn et al.
2,664,005 A * 12/1953 Kosinski ..... 211/70.1
2,761,640 A 9/1956 Frater
3,097,746 A 7/1963 Handler et al.
D211,139 S 5/1968 Nowak
3,389,949 A 6/1968 Studinski et al.
3,548,505 A 12/1970 Candilo
3,572,874 A 3/1971 Hassel
3,581,906 A 6/1971 Joyce
3,809,352 A 5/1974 Mathias
3,905,484 A 9/1975 Dean et al.
4,029,282 A 6/1977 Dauth
4,064,813 A 12/1977 Hewett et al.
4,067,632 A 1/1978 Sekerich
4,070,076 A 1/1978 Zwillinger
4,155,312 A * 5/1979 Thorkildson ..... 108/137
4,258,892 A 3/1981 Craine
4,295,693 A 10/1981 Viklund
4,485,922 A * 12/1984 Desmond et al. ..... 206/485
(Continued)

OTHER PUBLICATIONS

The Durham Manufacturing Company Storage Products Brochure No. SE-1194, pp. 1-20, copyrighted in 1995.

*Primary Examiner* — Teri P. Luu
*Assistant Examiner* — Devin Barnett
(74) *Attorney, Agent, or Firm* — Fay Sharpe LLP; James E. Scarbrough

(57) ABSTRACT

A shelf for a metal cabinet has a planar member, a ramped member extending from the planar member having a first, curved portion and a second, straight portion. The first, curved portion and second, straight portion are connected via a third, curved portion therebetween. The first curved portion has a first radius, and the second, curved portion has a second radius different from the first radius. The straight portion forms an outer wall of the shelf.

17 Claims, 4 Drawing Sheets

U.S. PATENT DOCUMENTS

| | | | | |
|---|---|---|---|---|
| 4,681,381 | A | 7/1987 | Sevey | |
| D297,111 | S | 8/1988 | Thompson et al. | |
| D300,147 | S | 3/1989 | Meyer et al. | |
| D309,540 | S | 7/1990 | Suttles et al. | |
| D311,285 | S | 10/1990 | Mastrodicasa | |
| D314,114 | S | 1/1991 | Steinman | |
| 5,058,765 | A | 10/1991 | Gomi et al. | |
| D323,091 | S | 1/1992 | Boschetto | |
| D333,394 | S | 2/1993 | Warrington | |
| D334,494 | S | 4/1993 | Stein | |
| 5,209,452 | A | 5/1993 | Goldberg | |
| 5,267,383 | A | 12/1993 | Sawdon | |
| 5,299,688 | A | 4/1994 | McKay et al. | |
| 5,329,835 | A | 7/1994 | Timp et al. | |
| 5,470,143 | A | 11/1995 | Gill | |
| 5,613,449 | A | 3/1997 | Pullman | |
| 5,695,261 | A | 12/1997 | Slesinger et al. | |
| 5,702,011 | A | 12/1997 | Carroll | |
| D392,131 | S | 3/1998 | Flagg | |
| 5,737,819 | A | 4/1998 | Sawdon et al. | |
| D395,369 | S | 6/1998 | Whittington | |
| 5,785,401 | A | 7/1998 | Bowyer et al. | |
| D402,143 | S | 12/1998 | Zapf | |
| D407,011 | S | 3/1999 | Boije | |
| 5,927,838 | A | 7/1999 | Hellman, Jr. | |
| 5,984,442 | A | 11/1999 | Hellman, Jr. | |
| D424,330 | S | 5/2000 | DeWitt | |
| 6,076,908 | A | 6/2000 | Maffeo | |
| D429,417 | S | 8/2000 | Liebers et al. | |
| D431,403 | S | 10/2000 | Ford | |
| 6,170,674 | B1 | 1/2001 | Caterinacci | |
| 6,279,445 | B1 | 8/2001 | Rosene et al. | |
| 6,302,369 | B1 | 10/2001 | Liebers et al. | |
| D455,755 | S | 4/2002 | Levine et al. | |
| D457,364 | S | 5/2002 | Shea | |
| D458,484 | S | 6/2002 | Wood | |
| D461,977 | S | 8/2002 | Mitchell | |
| 6,490,820 | B1 | 12/2002 | Weakley | |
| 6,561,601 | B1 | 5/2003 | Maffeo | |
| D507,131 | S | 7/2005 | Pingel | |
| D510,220 | S | 10/2005 | Sandy | |
| D525,059 | S | 7/2006 | Golias, Sr. et al. | |
| 7,128,379 | B1 * | 10/2006 | LaBonia et al. | 312/351 |
| D541,563 | S * | 5/2007 | LaBonia et al. | D6/511 |
| D568,648 | S | 5/2008 | Roussel et al. | |
| 7,452,039 | B1 * | 11/2008 | Golias et al. | 312/257.1 |
| D593,783 | S | 6/2009 | Golias, Jr. et al. | |
| 7,806,282 | B1 | 10/2010 | LaBonia, Jr. et al. | |
| 2005/0109722 | A1 * | 5/2005 | Golias et al. | 211/135 |
| 2006/0207950 | A1 * | 9/2006 | Kiehnau et al. | 211/59.2 |

* cited by examiner

FIG. 1
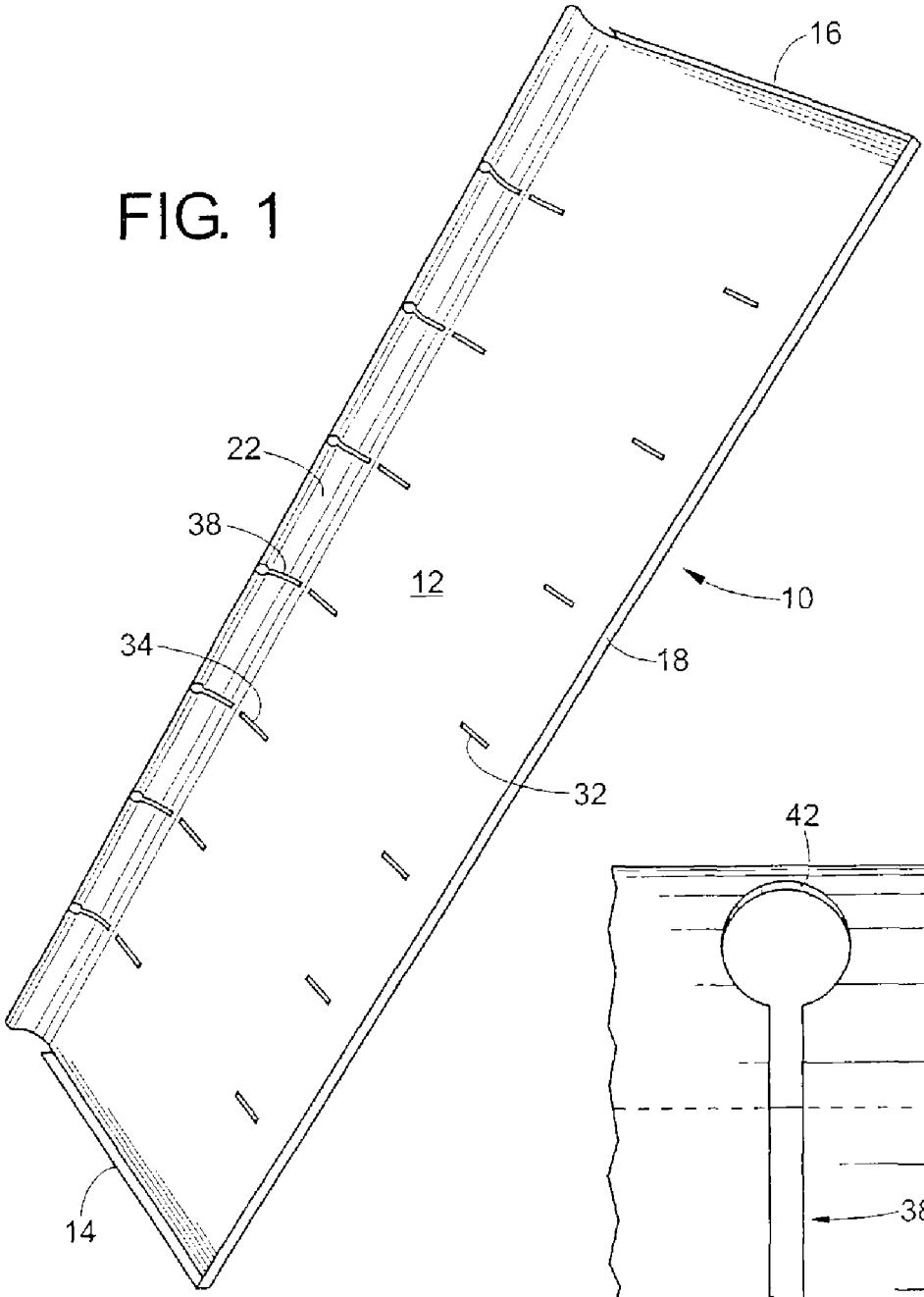
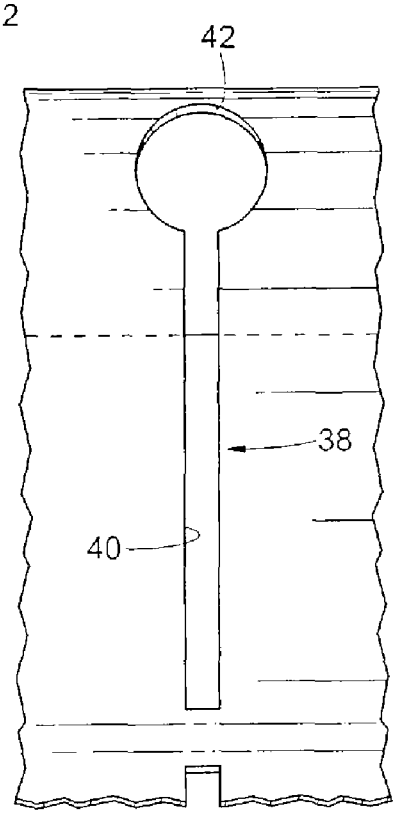
FIG. 3

CURVED BIN FOR SHELF

CLAIM OF PRIORITY

This application claims priority from Provisional Application Ser. No. 60/876,233, filed on Dec. 21, 2006.

BACKGROUND

The present invention relates generally to units for storage. More particularly, the invention relates to an improved shelf member for a cabinet, such as a metal cabinet.

Metal cabinets and compartment bins are very versatile in that the cabinets can be placed in many areas, such as metal or woodworking shops, garages, as well as many other places. The cabinets and compartment bins can also provide storage in vehicles, such as trucks and vans. Metal cabinets have been used to store a variety of items such as threaded rod, wire, brake line, welding rods, as well as more common items, such as tools and fasteners.

When storing an item on a cabinet shelf, it can be difficult to retrieve the item if the shelf is substantially horizontal. For example, if one is trying to scoop a handful of bolts from a shelf, the vertical and straight front wall of the shelf tends to make it difficult to pull the bolts off the shelf.

Accordingly, it is desired to provide a cabinet with a curved shelf which aids in manually removing loose items from the cabinet.

SUMMARY OF THE INVENTION

In accordance with one aspect of the invention, a shelf for a metal cabinet has a planar member, a ramped member extending from the planar member, comprising a first, curved portion and a second, straight portion, wherein the first, curved portion and the second, straight portion are connected via a third, curved portion therebetween; wherein the first curved portion has a first radius, and the second, curved portion has a second radius different from said first radius; and wherein the straight portion forms an outer wall of the shelf.

In accordance with another aspect of the invention, a cabinet has first and second opposing side walls, a plurality of shelves, wherein each shelf is mounted to at least one of the side walls, each shelf including a ramped front wall and a planar wall, wherein the ramped front wall includes a first curved portion that extends at a radius from the planar portion and a second portion that depends downwardly from the first portion, wherein the ramped front wall includes a substantially key-shaped opening having an elongated narrow portion terminating in a relatively wider portion adjacent an intersection of the first portion and the second portion of the ramped front wall; and a divider, wherein at least a portion of the divider is received in the opening of the ramped front wall.

In accordance with yet another aspect of the invention, a shelf for a cabinet has a planar portion and an integral ramped portion extending at a radius from the planar portion, the ramped portion including a key-shaped opening formed therethrough having a narrow portion and a rounded relatively wider portion adjacent an apex of the ramped portion, the relatively wider portion of the opening being dimensioned to accommodate a reinforced rolled end of an associated divider.

Still other aspects of the invention will become apparent to those skilled in the art upon reading and understanding the following detailed description.

BRIEF DESCRIPTION OF THE DRAWINGS

The foregoing and other objects and advantages will in part be obvious and in part pointed out in the following description taken together with the accompanying drawings in which:

FIG. 1 is a rear perspective view of a cabinet shelf having a curved ramp;

FIG. 3 is a close-up view of a keyed slot in a front wall portion of the shelf of FIG. 1;

DETAILED DESCRIPTION OF THE PREFERRED EMBODIMENT

Referring now in greater detail to the drawings, wherein the showings are for the purpose of illustrating preferred embodiments of the invention only, and not for the purpose of limiting the invention, FIGS. 1-5 illustrate a preferred embodiment of the present invention.

Figure 6:
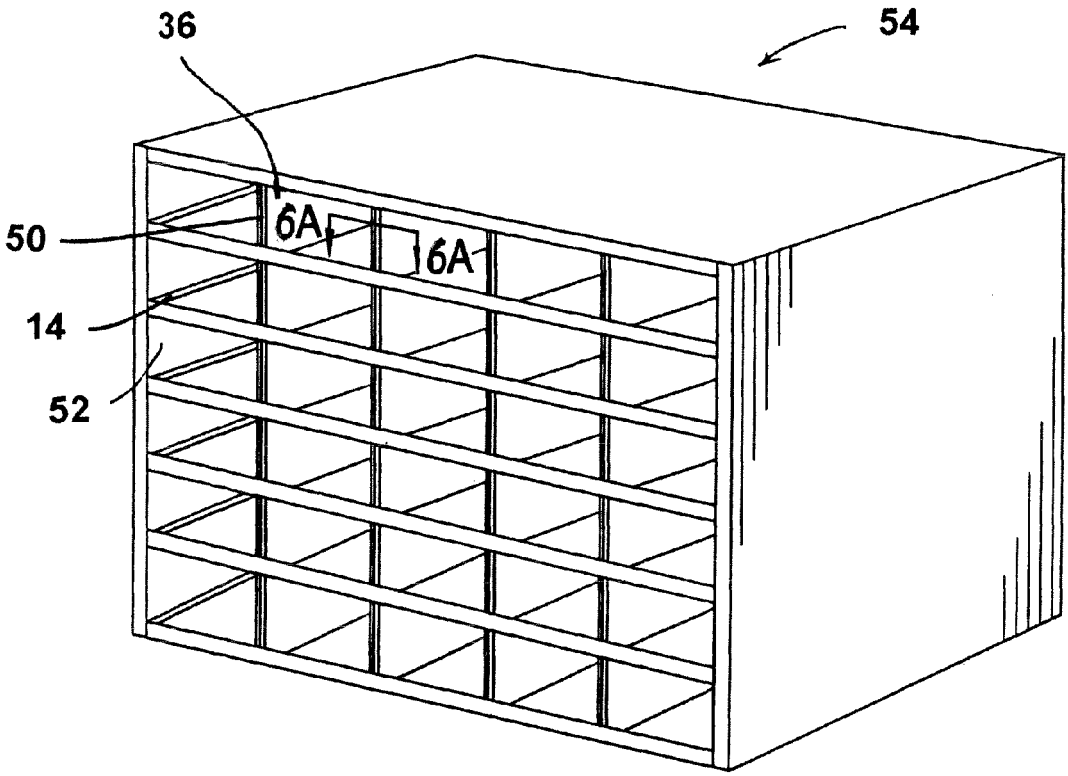
FIG. 6 is a perspective view of the cabinet depicted in FIG. 5.

With reference now to FIG. 1, a shelf 10 includes a sheet or planar member 12, side walls 14 and 16, rear wall 18, and a curved, ramped front portion 22. Shelf 10 is formed from a rigid metal or other suitable material. Sheet 12 is shown to be substantially rectangular; however, the sheet could take other suitable configurations for various shaped or sized cabinets without departing from the scope of the invention. Side walls 14 and 16 each extend substantially orthogonally from sheet 12. The side wall 16 is positioned at an opposite longitudinal end of sheet 12 as the side wall 14. Rear wall 18 extends from an edge of the sheet between side walls 14 and 16 and also extends substantially orthogonally from sheet 12. Side walls 14 and 16 provide a surface of attachment for the shelf 10 to a corresponding side wall 52 of cabinet 54 (see FIG. 6). Likewise, the rear wall 18 also provides a surface to attach the shelf 10 to a rear wall of a cabinet.

Figure 2:
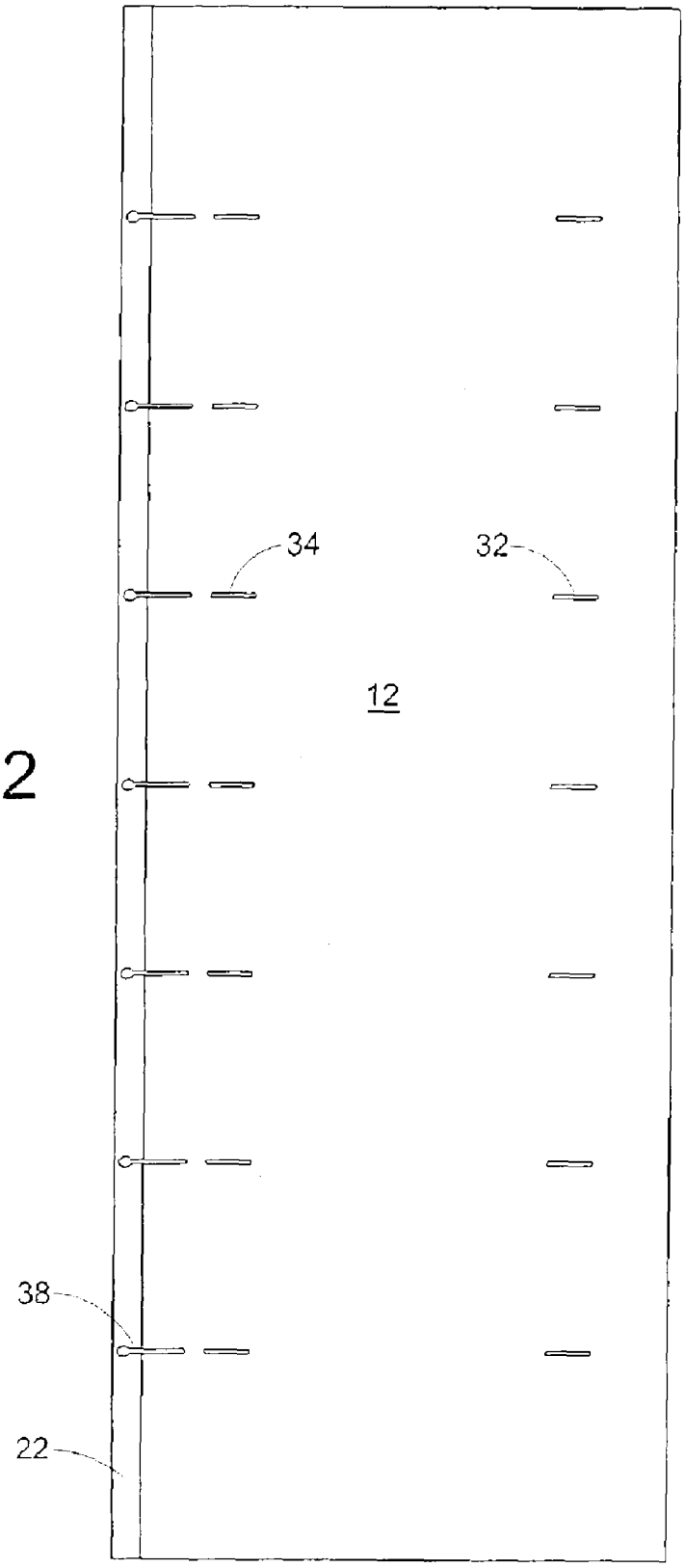
FIG. 2 is a top plan view of the shelf and curved ramp of FIG. 1.
Figure 4:
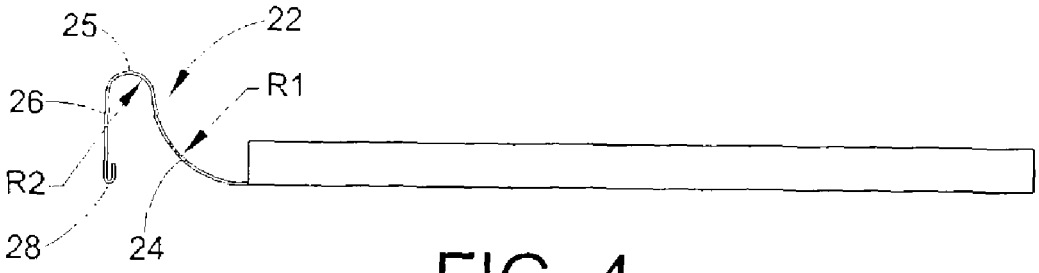
FIG. 4 is a side elevation view of the shelf and the curved ramp.
Figure 5:
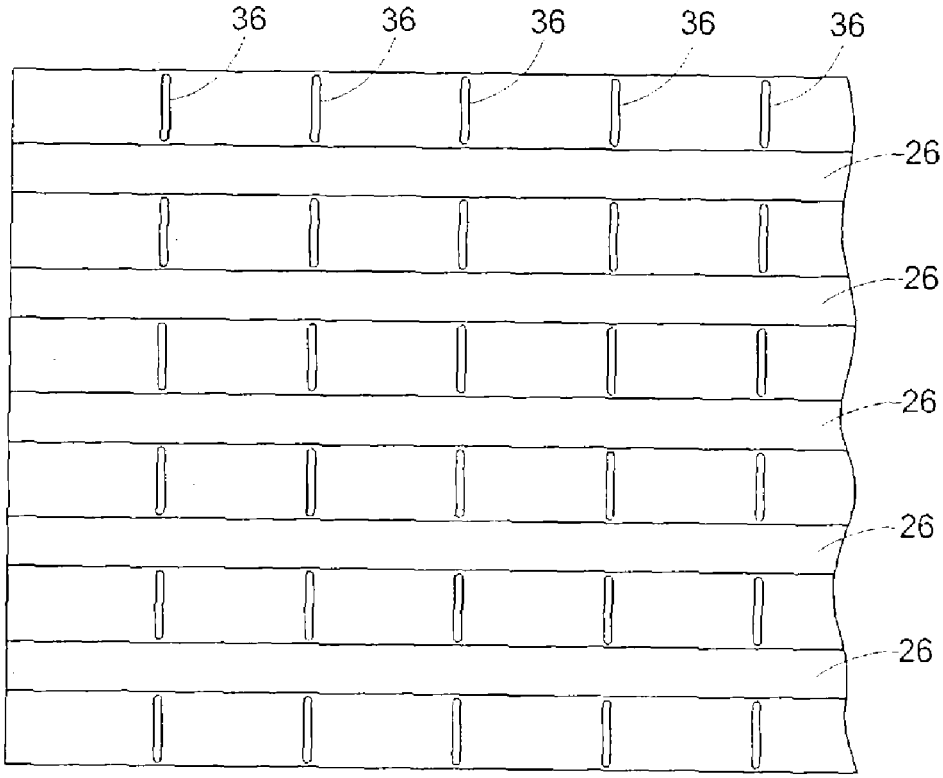
FIG. 5 is a front view of a cabinet including the cabinet shelf of FIG. 1.

Curved ramped front portion 22 is positioned opposite the rear wall 18. Referring now to FIGS. 2 and 4, the ramped curved portion 22 includes a first, curved surface or wall 24 extending at a constant radius R1 and a straight or substantially vertical wall 26. Curved wall 24 extends upwardly from sheet 12 forming a constant radius R1 between the curved wall and the sheet. Radius R1 is preferably ¾ to 1¼ inches long. Vertical wall 26 extends in a downwardly direction from the curved wall 24. A rounded bend or upper corner or curved portion 25 having a constant radius R2 is formed between walls 24 and 26. Radius R1 extends between planar member 12 and upper corner or curved portion 25. Radius R2 is preferably smaller than R1, is a reverse radius compared to R1, and has a radius in the range of approximately 0-1 inches. Radius R2 extends between curved wall 24 and straight wall 26. Wall 26 forms the front wall when viewing the shelf 10 from the front of the cabinet (FIG. 5). Wall 26 can also include a crimped or rolled-over edge portion 28 at a lower most edge which provides a rounded edge for the front portion of the shelf 10.

With reference now to FIGS. 1 and 2, the shelf further includes a plurality of rear slots 32 disposed adjacent the rear wall and a plurality of front slots 34 disposed adjacent the ramped front portion 22. Slots 32 can be equally spaced apart and parallel to each other. Likewise, slots 34 can be equally spaced apart and parallel to each other. The slots can also be unevenly spaced as well without departing from the scope of the present invention. Referring to FIGS. 2 and 5, slots 32 and 34 are aligned with one another along a longitudinal direction and receive a portion of dividers 36 that divide the shelf 10 into a plurality of compartments defined by adjacent parallel slots.

Figure 6A:
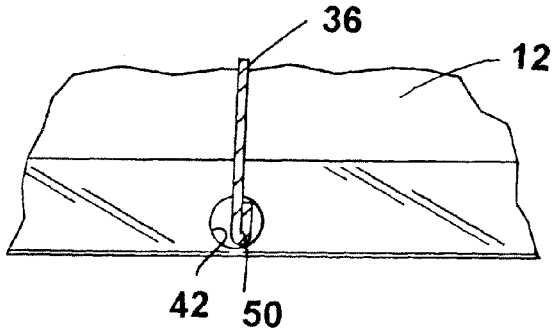
FIG. 6A is a cross-sectional view taken at line 6A-6A of FIG. 6.

The curved ramped front portion 22 also includes a plurality of openings or slots 38 aligned with rear slots 32 and front slots 34. Slots 38 in the ramped front portion also receive the same dividers 36 that slots 32 and 34 receive. Referring now to FIG. 3, each slot in the curved ramped front portion can have a substantially key-shaped conformation, including a first, narrow elongated portion 40 terminating in a second, relatively wider circular portion or round aperture 42 adjacent the intersection of the curved wall 24 and the vertical wall 26 of the ramped front wall. Aperture 42 provides a larger opening allowing for an easier insertion of the divider 36 into the slot 38, thus reducing assembly time. The narrow elongated portion 40 extends from the circular portion 42 and terminates at or adjacent the planar member 12. A reinforced rolled end 50 (FIG. 6A) of the divider can be received within the slot. The keyed slot 38 also adds strength and rigidity to a divider since the divider wall has support from the curved ramped front portion on both sides of the divider. The slot further aids the divider wall in maintaining a vertical position in the cabinet.

The curved portion 22 provides an abutment so that when the user attempts to retrieve a handful of items from a compartment that is defined by two adjacent dividers 36 and the shelf 10, the ramped front portion serves as a scoop to aid the user in retrieving items from the shelf. Furthermore, items that are not retrieved will roll back into the shelf and not fall from the shelf. The curved configuration of the shelf allows the user to easily retrieve items from the bin without risk of injury due to sharp corners. The curved ramp is aesthetically pleasing while also aiding the user in retrieving items.

The shelf member has been described with reference to a preferred embodiment. Obviously, modifications and alterations will occur to others upon the reading and understanding of this specification. The specification is intended to include all such modifications and alterations insofar as they come within the scope of the appended claims or the equivalents thereof.

The invention claimed is:

1. A shelf for a metal cabinet, comprising:

a horizontal planar member, a ramped curved portion extending from said horizontal planar member, comprising a first, curved wall portion comprising a first constant radius portion which directly extends into a reverse second constant radius portion, said second constant radius portion extends into a second, vertical straight wall portion and wherein said second constant radius portion comprises a pair of parallel spaced apart portions wherein one of said parallel portions extends from said first constant radius portion and another of said parallel portions extends into said second vertical wall portion;

wherein said second constant radius comprises a second radius different from said first constant radius;

wherein said second vertical straight wall portion forms a front wall of said shelf; and wherein said first curved wall portion includes a key-shaped opening having an elongated narrow slot terminating in a circular portion adjacent an intersection of said ramped curved portion and said horizontal planar member; said key-shaped opening configured to receive a rolled end of a divider wall; and wherein said second straight wall portion includes a rolled-over edge at a bottom end of said straight wall portion, said rolled-over edge comprises a curved wall extending upwardly.

2. The shelf of claim 1, wherein at least one side wall extends substantially orthogonally from the planar member.

3. The shelf of claim 1, wherein said circular portion of the key-shaped opening is wider than said elongated narrow slot.

4. The shelf of claim 1, wherein said second, straight wall portion is situated substantially perpendicular to the planar member.

5. A cabinet comprising:

first and second opposing side walls;

a plurality of shelves, wherein each shelf is mounted to at least one of the side walls, each shelf including a curved front portion and a horizontal planar member, wherein the curved front portion comprises a curve having a first constant radius which inverts into a second constant radius, said second constant radius comprises a pair of parallel spaced apart portions wherein one of said parallel portions extends from said first constant radius and another of said parallel portions extends into a second vertical straight wall that depends downwardly from the second constant radius, wherein the curved front portion includes a substantially key hole shaped opening having a first elongated portion terminating in a second, relatively wider circular portion adjacent an intersection of the first curved wall and the second vertical straight wall of the curved front portion;

a divider, wherein at least a rolled-edge portion of the divider is received in the opening of said curved front portion; and wherein the second straight wall of said curved first portion includes a lower rolled-over edge formed by an upwardly extending curved wall.

6. The cabinet of claim 5, wherein the relatively wider circular portion of the opening includes at least one curved edge adjacent the intersection of the first curved wall and the second straight wall of the curved front portion.

7. The cabinet of claim 6, wherein the elongated portion of the opening of said curved front portion includes an elongated slot extending towards the planar member.

8. The cabinet of claim 7, wherein the elongated slot terminates adjacent the planar member.

9. The cabinet of claim 5, wherein the shelf includes a first slot formed in the planar member and aligned with the opening of said curved front portion, wherein at least a portion of the divider is received in the first slot.

10. The cabinet of claim 9, wherein the first slot is at least substantially perpendicular to the second straight wall of the curved front portion.

11. The cabinet of claim 9, wherein the shelf includes a second slot formed in the planar member and aligned with the first slot, wherein at least a portion of the divider is received in the second slot.

12. The cabinet of claim 5, wherein the divider includes a rolled end and the rolled end is received by the opening of said curved front portion.

13. The cabinet of claim 5, further comprising a rear wall connected to the first side wall and the second side wall, and the shelf includes a rear wall portion extending from the planar member, the rear wall portion of the shelf attaches to the rear wall of the cabinet.

14. A shelf for a cabinet comprising:

a planar member and an integral curved ramped portion having a first curved wall comprises a curve having a first continuous radius and a second continuous radius wherein said curve is formed only by said first continuous radius and said second continuous radius, said second continuous radius comprises a first portion and second portion which are parallel to one another, said first portion extends from said first continuous radius and said second portion extends into a second, vertical wall, the curved ramped portion including a key hole shaped opening formed therethrough having an elongated portion and a relatively wider circular portion adjacent an apex of the curved ramped portion, the relatively wider circular portion of the opening being dimensioned to accommodate a reinforced rolled-over edge of an associated divider and said second, vertical wall comprises a rolled-over edge at a bottom end of said second wall, said rolled-over edge comprises a curved wall extending upwardly.

15. The shelf of claim 14, further comprising at least one slot formed in the planar member and aligned with the opening for receiving the associated divider that is received in the opening.

16. The shelf of claim 15, further comprising at least two aligned slots formed in the planar member for receiving the associated divider that is received in the opening.

17. The shelf of claim 14, further comprising an integral side wall extending substantially orthogonally from the shelf, an end of the side wall being spaced from the integral curved ramped portion.

* * * * *